US007736207B2

(12) United States Patent
Vignau

(10) Patent No.: US 7,736,207 B2
(45) Date of Patent: Jun. 15, 2010

(54) MARINE OUTBOARD ENGINE HAVING A PADDED SECTION

(75) Inventor: Pierre Vignau, Sherbrooke (CA)

(73) Assignee: BRP US Inc., Sturtevant, WI (US)

( * ) Notice: Subject to any disclaimer, the term of this patent is extended or adjusted under 35 U.S.C. 154(b) by 45 days.

(21) Appl. No.: 12/171,411

(22) Filed: Jul. 11, 2008

(65) Prior Publication Data

US 2009/0017706 A1 Jan. 15, 2009

Related U.S. Application Data

(60) Provisional application No. 60/949,543, filed on Jul. 13, 2007.

(51) Int. Cl.
*B63H 20/32* (2006.01)

(52) U.S. Cl. ..... 440/77

(58) Field of Classification Search ..... 440/77
See application file for complete search history.

(56) References Cited

U.S. PATENT DOCUMENTS

| | | | | |
|---|---|---|---|---|
| 2,346,148 | A | 4/1944 | Bosma | |
| 2,475,135 | A * | 7/1949 | Haven | 206/319 |
| 2,549,483 | A | 4/1951 | Kiekhaefer | |
| 2,549,485 | A | 4/1951 | Kiekhaefer | |
| 2,676,559 | A | 4/1954 | Davies | |
| 3,119,365 | A | 1/1964 | Evans | |
| 3,377,095 | A * | 4/1968 | Allen | 294/15 |
| 3,503,360 | A | 3/1970 | Hoff | |
| 4,098,218 | A | 7/1978 | Pichl | |
| 4,412,826 | A | 11/1983 | Jones et al. | |
| 4,676,756 | A | 6/1987 | Rodrigue et al. | |
| 4,678,440 | A | 7/1987 | Rodrigue et al. | |
| 4,687,448 | A | 8/1987 | Peirce | |
| 4,738,644 | A | 4/1988 | Happel | |
| 5,069,644 | A | 12/1991 | Kobayashi et al. | |
| 5,181,870 | A | 1/1993 | Arai et al. | |
| 5,215,485 | A | 6/1993 | Bonner et al. | |
| 5,295,879 | A | 3/1994 | Meier et al. | |
| 5,399,113 | A | 3/1995 | DeMasi | |
| 5,445,547 | A | 8/1995 | Furukawa | |
| 5,501,202 | A | 3/1996 | Watanabe | |
| 5,509,836 | A | 4/1996 | Ogasawara et al. | |
| 5,544,795 | A * | 8/1996 | Perrin | 224/254 |
| 5,938,491 | A | 8/1999 | Kawai et al. | |
| 6,024,616 | A | 2/2000 | Takayanagi | |
| 6,095,877 | A | 8/2000 | Kawamukai et al. | |
| 6,106,342 | A | 8/2000 | Kameoka | |
| 6,149,475 | A | 11/2000 | Tasaka et al. | |
| 6,227,921 | B1 | 5/2001 | Feehan | |
| 6,352,456 | B1 | 3/2002 | Jaszewski et al. | |

(Continued)

OTHER PUBLICATIONS

Title: 1953 AD Johnson Seahorse 10ho Outboard Motor Man Carry URL: http://cgi.ebay.com.

(Continued)

*Primary Examiner*—Stephen Avila
(74) *Attorney, Agent, or Firm*—Osler, Hoskin & Harcourt LLP

(57) ABSTRACT

A marine outboard engine for a watercraft is disclosed. The marine outboard engine features a padded section adapted to provide a padded area for carrying the outboard engine over the shoulder of a person.

15 Claims, 7 Drawing Sheets

U.S. PATENT DOCUMENTS

| | | | | |
|---|---|---|---|---|
| 6,390,865 | B1 | 5/2002 | Kameoka | |
| 6,488,552 | B2 | 12/2002 | Kitsu et al. | |
| 6,579,135 | B2 | 6/2003 | Nemoto et al. | |
| 6,719,597 | B2 | 4/2004 | Yoshioka et al. | |
| 6,821,170 | B2 | 11/2004 | Sanschagrin et al. | |
| 6,875,066 | B2 | 4/2005 | Wolaver | |
| 7,210,973 | B2 * | 5/2007 | Sanschagrin et al. | 440/77 |
| 2001/0012740 | A1 | 8/2001 | Kitsu et al. | |
| 2003/0054708 | A1 | 3/2003 | Yoshioka et al. | |
| 2003/0194927 | A1 | 10/2003 | Sanschagrin et al. | |
| 2004/0009719 | A1 | 1/2004 | Sanschagrin et al. | |
| 2004/0009720 | A1 | 1/2004 | Vignau | |
| 2004/0014378 | A1 | 1/2004 | Sanschagrin et al. | |
| 2005/0164573 | A1 | 7/2005 | Sanschagrin | |
| 2005/0186863 | A1 | 8/2005 | Nakamura | |
| 2005/0191915 | A1 | 9/2005 | Nakamura | |
| 2005/0208846 | A1 | 9/2005 | Nakamura et al. | |

OTHER PUBLICATIONS

Title: Evinrude outboard motor, lightwind 4 hop and carry case URL: http://cgi.ebay.com.

* cited by examiner

MARINE OUTBOARD ENGINE HAVING A PADDED SECTION

CROSS-REFERENCE

The present application claims priority to U.S. Provisional Patent Application No. 60/949,543 filed on Jul. 13, 2007, the entirety of which is incorporated herein by reference.

FIELD OF THE INVENTION

The present invention relates generally to a marine outboard engine and in particular to a marine outboard engine having a padded section.

BACKGROUND OF THE INVENTION

Small outboard engines for boats or watercrafts are typically provided with a handle on the stern bracket of the outboard engine and another handle on the rear of the cowling of the engine to enable the user to lift, carry, manipulate, and mount the outboard engine onto the rear end of the watercraft.

In situations where the outboard engine must be carried over relatively long distances to be brought to a river bank or a lake shore from the side of a road for example, boater must carry the outboard engine as best they can over often uneven terrain. The handle on the stern bracket of the outboard engine and the other handle on the back of the cowling only provide an awkward grip that makes it difficult to carry the outboard engine over relatively long distances. In these instances, boaters have adopted carrying the outboard engine over their shoulders. Boaters will typically put the outboard engine 9 on its skeg, kneel down, shift the weight of the outboard engine over one shoulder and lift the outboard engine 9 on their shoulder for transport as illustrated in FIG. 1. The outboard engine resting over one's shoulders is easier to carry than when held with both hands gripping the handles provided to manipulate the outboard engine.

However, marine outboard engine are relatively heavy; the lightest outboard engine on the market weight approximately 34 Kg (75 lbs) for a 9.9 hp engine size. Because of that, the weight of the outboard engine digs into to the shoulder on which it rests thus making the process of carrying the outboard engine uncomfortable at best and often painful especially if the outboard engine weighs over 38 Kg (85 lbs).

Thus, there is a need for a marine outboard engine adapted to be carried over one's shoulders more comfortably than existing marine outboard engine and with relative ease.

STATEMENT OF THE INVENTION

One aspect of the present invention is to provide a marine outboard engine comprising: a cowling; an engine disposed in the cowling; a skeg extending from the cowling; a transmission operatively connected to the engine; a bladed rotor operatively connected to the transmission; and a padded section connected to the cowling and adapted for cushioning the marine outboard engine when carried over a shoulder of a person.

In another aspect, the cowling includes an upper motor cover and a lower motor cover, the upper motor cover positioned above the lower motor cover and detachable from the lower motor cover; the padded section being connected to a rear portion of the lower motor cover.

In a further aspect, the padded section includes at least one cushion.

In an additional aspect, the padded section includes a molded frame having a first side and a second side, the at least one cushion being connected to the first side of the molded frame, the second side of the molded frame being connected to the cowling of the marine outboard engine.

In a further aspect, the lower motor cover includes a recessed portion in the rear portion thereof, the second side of the molded frame of the padded section connected with the recessed portion.

In an additional aspect, the padded section is divided into a left side padded section and a right side padded section, the left side padded section and the right side padded section being mounted separately onto a left side and a right side of the cowling respectively.

In a further aspect, the at least one cushion of the padded section is bonded or overmolded directly onto the lower motor cover.

In yet another aspect, the lower motor cover includes separate left and right side and the padded section includes a left side cushion and a right side cushion, the left and right side cushion are connected directly onto the left side and the right side of the lower motor cover respectively.

In an additional aspect, the padded section includes a curved profile adapted to conform at least partially to a contour of a shoulder of a person. The curved profile includes an apex, the apex of the curved profile of the padded section providing a center point on which to balance the outboard engine when the outboard engine is resting on the shoulder of the person.

In another aspect the apex of the curved profile of the padded section is located below the center of gravity of the marine outboard engine when the marine outboard engine is in the upright position.

Embodiments of the present invention each have at least one of the above-mentioned objects and/or aspects, but do not necessarily have all of them. It should be understood that some aspects of the present invention that have resulted from attempting to attain the above-mentioned objects may not satisfy these objects and/or may satisfy other objects not specifically recited herein.

Additional and/or alternative features, aspects, and advantages of embodiments of the present invention will become apparent from the following description, the accompanying drawings, and the appended claims.

BRIEF DESCRIPTION OF THE DRAWINGS

For a better understanding of the present invention as well as other aspects and further features thereof, reference is made to the following description which is to be used in conjunction with the accompanying drawings, where.

DESCRIPTION OF PREFERRED EMBODIMENT(S)

Figure 2:
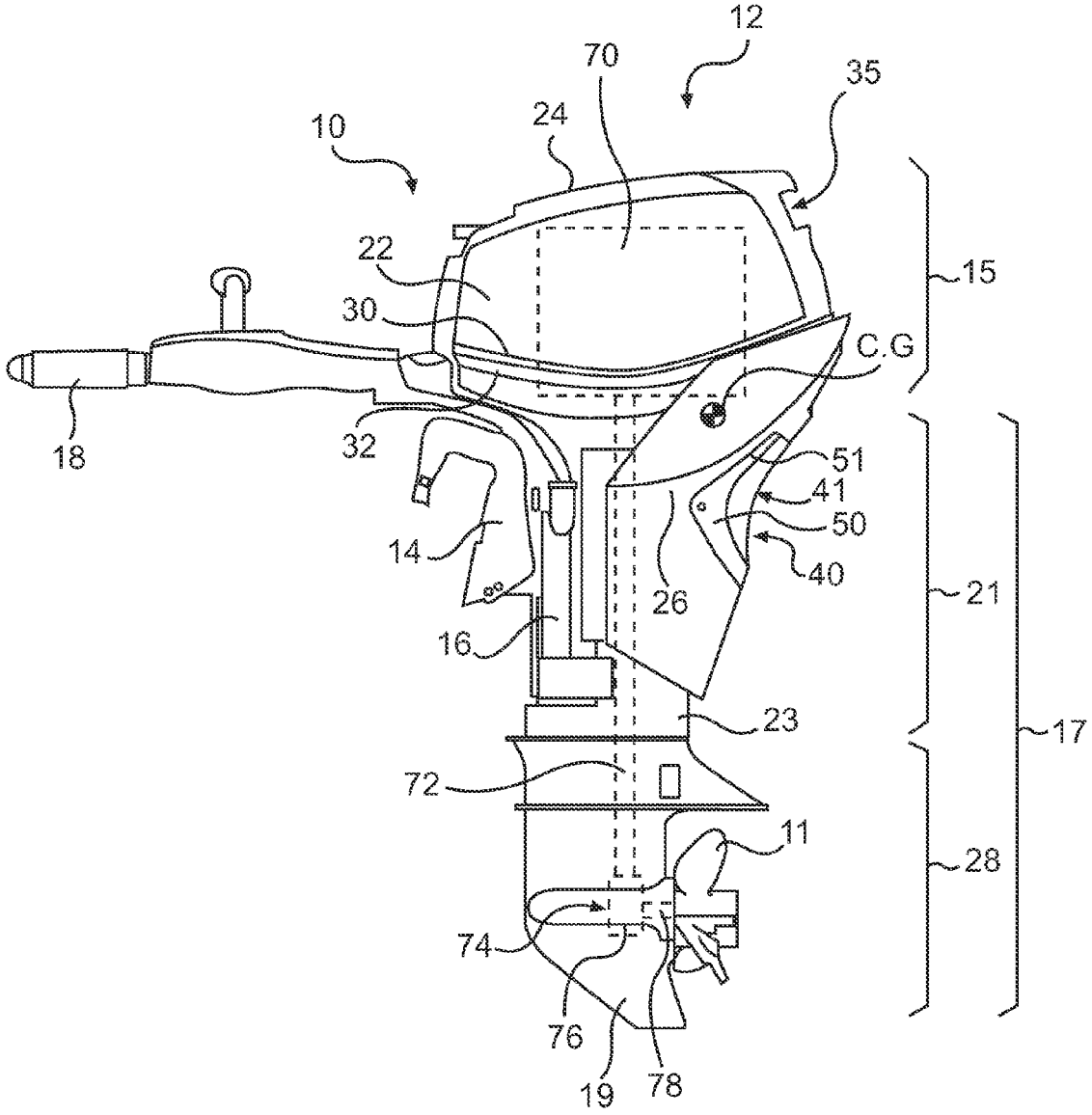
FIG. 2 is a left side elevational view of a marine outboard engine in accordance with a first embodiment of the invention.

Referring to the figures, FIG. 2 is a side view of a marine outboard engine 10 having a cowling 12, the marine outboard engine 10 being in an upright position. The outboard engine 10 includes a top portion 15 and a bottom portion 17 which includes the mid-section 21, the gear case assembly 28, and the skeg portion 19 as well as the bladed rotor of the marine outboard engine 10.

The cowling 12 surrounds and protects an engine 70 housed within the cowling 12. The engine 70 is a conventional two-stroke internal combustion engine, such as an in-line two-stroke, two-cylinder engine. It is contemplated that other types of engine could be used, such as a four-stroke engine.

The engine 70 is coupled to a vertically oriented driveshaft 72. The driveshaft 72 is coupled to a drive mechanism 74, which includes a transmission 76 and a bladed rotor, such as the propeller 11 mounted on a propeller shaft 78. The driveshaft 72 as well as the drive mechanism 74 is housed within the bottom portion 17, and transfers the power of the engine 70 to the propeller 11 mounted on the rear side of the gear case assembly 28 of the outboard engine 10. The propulsion system of the outboard engine 10 could also include a jet propulsion device, turbine or other known propelling device. The bladed rotor could also be an impeller. Other known components of an engine assembly are included within the cowling 12, such as a starter motor and an alternator. As it is believed that these components would be readily recognized by one of ordinary skill in the art, further explanation and description of these components will not be provided herein.

A stern bracket 14 is connected to the engine 10 via the swivel bracket 16 for mounting the outboard engine 10 to a watercraft. The stern bracket 14 can take various forms, the details of which are conventionally known. The swivel bracket 16 is pivotally connected to the stern bracket 14 such that the angle of outboard engine 10 relative to the watercraft may be changed in order to steer the watercraft.

In the specific embodiment shown in FIG. 2, a tiller 18 is operatively connected to the cowling 12 to allow manual steering of the outboard engine 10. It is contemplated that other steering mechanisms could be provided to allow steering, such as the steering wheel of a boat.

The cowling 12 includes an upper motor cover assembly 22 with a top cap 24, and a lower motor cover 26. The lowermost portion, commonly called the gear case assembly 28 and including the skeg portion 19, is attached to the exhaust housing 23 located in the mid-section 21 and partially hidden by the lower motor cover 26. The upper motor cover 12 preferably encloses the top portion of the engine 70. The lower motor cover 26 surrounds the remainder of the engine 70 and the exhaust system. The mid-section 21 of the outboard engine 10 is the vertical portion of the outboard engine 10 extending from the lower motor cover 26 to the gear case assembly 28 and includes the lower half of the lower motor cover 26. The gear case assembly 28 encloses the transmission 76 and supports the drive mechanism 74 in a known manner. The propeller 11 is disposed behind the gear case assembly 28.

The upper motor cover 22 and the lower motor cover 26 are made of sheet material, preferably plastic, but could also be metal, composite or the like. The lower motor cover 26 and/or other components of the cowling 12 can be formed as a single piece or as several pieces. For example, the lower motor cover 26 can be formed as two lateral pieces mating along a vertical joint. The lower motor cover 26, which is also made of sheet material, is preferably made of plastic, but could also be metal, composites or the likes. One suitable composite is a sheet molding compound (SMC) which is typically a fibreglass reinforced sheet molded to shape.

A lower edge 30 of the upper motor cover 22 mates in a sealing relationship with an upper edge 32 of the lower motor cover 26. A seal is disposed between the lower edge 30 of the upper motor cover 22 and the upper edge 32 of the lower motor cover 26 to form a watertight connection.

A locking mechanism is provided on at least one of the sides or at the front and back of the cowling 12 to lock the upper motor cover 22 onto the lower motor cover 26. Preferably, two locking mechanisms are each provided on two opposite sides of the cowling 12. Front hook and rear latch is also commonly used for a small outboard engine.

The upper motor cover 22 is formed with two parts, but could also be a single cover. The upper motor cover 22 includes an air intake portion 35 formed as a recessed portion on the rear of the cowling 12. The air intake portion 35 is configured to prevent water from entering the interior of the cowling 12 and reaching the engine 70 housed therein. Such a configuration can include a tortuous path. The top cap 24 fits over the upper motor cover 22 in a sealing relationship and preferably defines a portion of the air intake portion 35. Alternatively, the air intake portion 35 can be wholly formed in the upper motor cover 22 without the use of a top cap 24 or in the lower motor cover 26.

Figure 1:
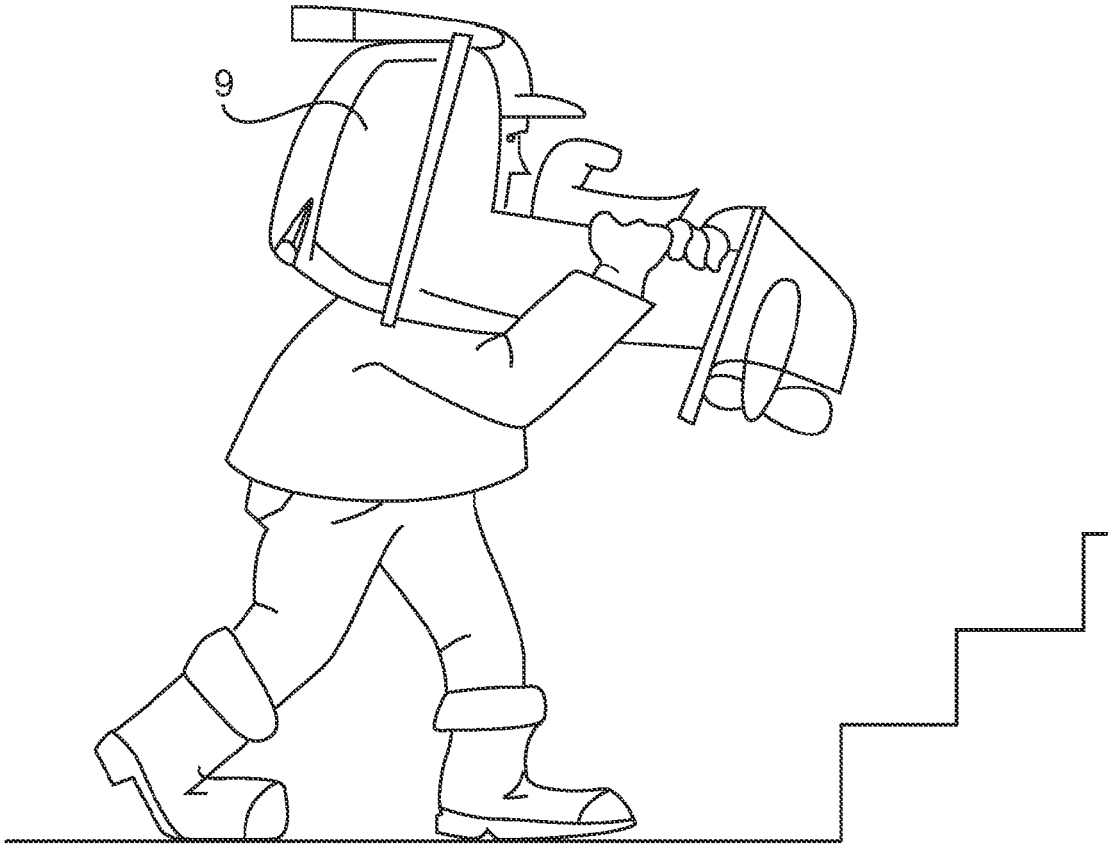
FIG. 1 is a schematic side elevational view of a prior art marine outboard engine being carried over one shoulder of a boater.
Figure 3:
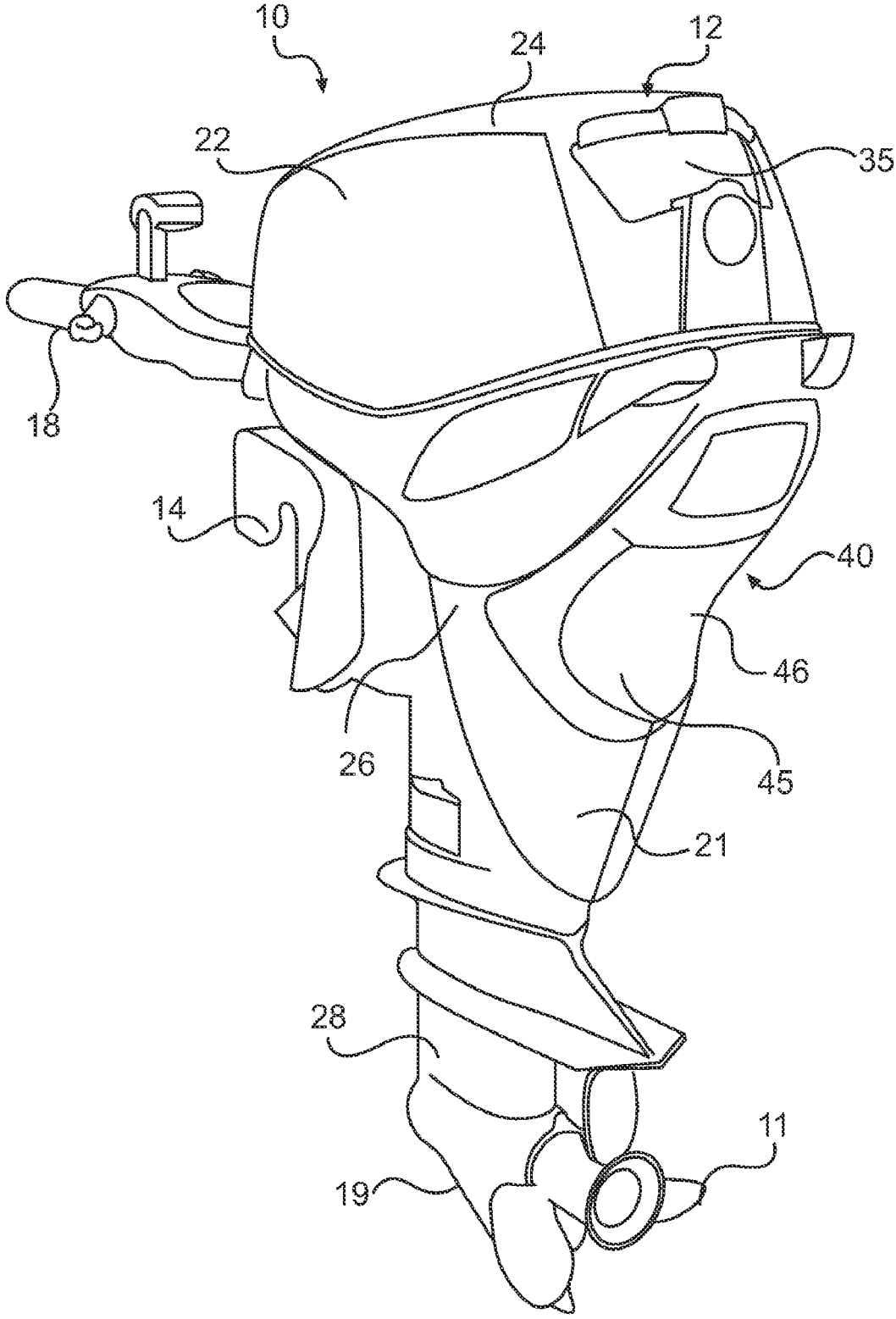
FIG. 3 is a perspective view, taken from a rear, left side, of the marine outboard engine shown in FIG. 2.

As best seen in FIG. 3, the lower motor cover 26 includes a padded section 40 positioned at the rear of the outboard engine 10 directly below the upper portion 15 of the outboard engine 10. As best shown in FIG. 2, the padded section 40 features a curved profile designed to accommodate the shoulder of a person transporting the outboard engine 10 in the same manner as illustrated in FIG. 1. The general curvature of the padded section 40 is adapted to hug a portion of the curvature of the shoulder and therefore spread the weight of the outboard engine 10 over a larger surface of the shoulder. An apex 41 of the curvature of the padded section 40 also provide a center point on which to balance the outboard engine 10 when it is resting on the shoulder of the person carrying it.

The apex 41 of the curvature of the padded section 40 is located slightly below the center of gravity C.G. (FIG. 2) of the outboard engine 10 such that when the outboard engine 10 is resting on the shoulder of the person at the apex 41 of the padded section 40, the bottom portion 17 of the outboard engine 10 tends to rise, making it easier for the person carrying it to balance the outboard engine 10 by holding on the mid-section 21 with his or her hands above the mid-section 21 in the same manner as illustrated in FIG. 1.

Figure 4:
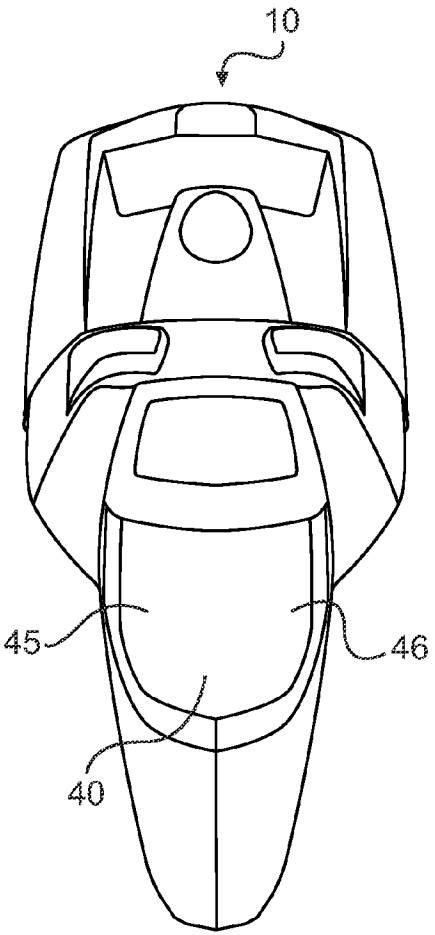
FIG. 4 is a partial rear elevational view of the marine outboard engine shown in FIG. 2.

As best shown in FIGS. 3 and 4, the padded section 40 extends on the left side and the right side of the outboard engine 10 and provides a large cushion for the shoulder of the carrier. The padded section 40 is divided into a left side 45 and a right side 46 that are shaped such that when the outboard engine 10 is resting on the shoulder of a person, the padded surface extends partially over the trapezoidal muscle around the neck thereby cushioning this sensitive area of the body and making it more comfortable to carry the outboard engine 10 over long distances or uneven terrain. Furthermore, the left side 45 and the right side 46 of the padded section 40 enable a person to carry the outboard engine 10 over either the right shoulder or the left shoulder.

Figure 5:
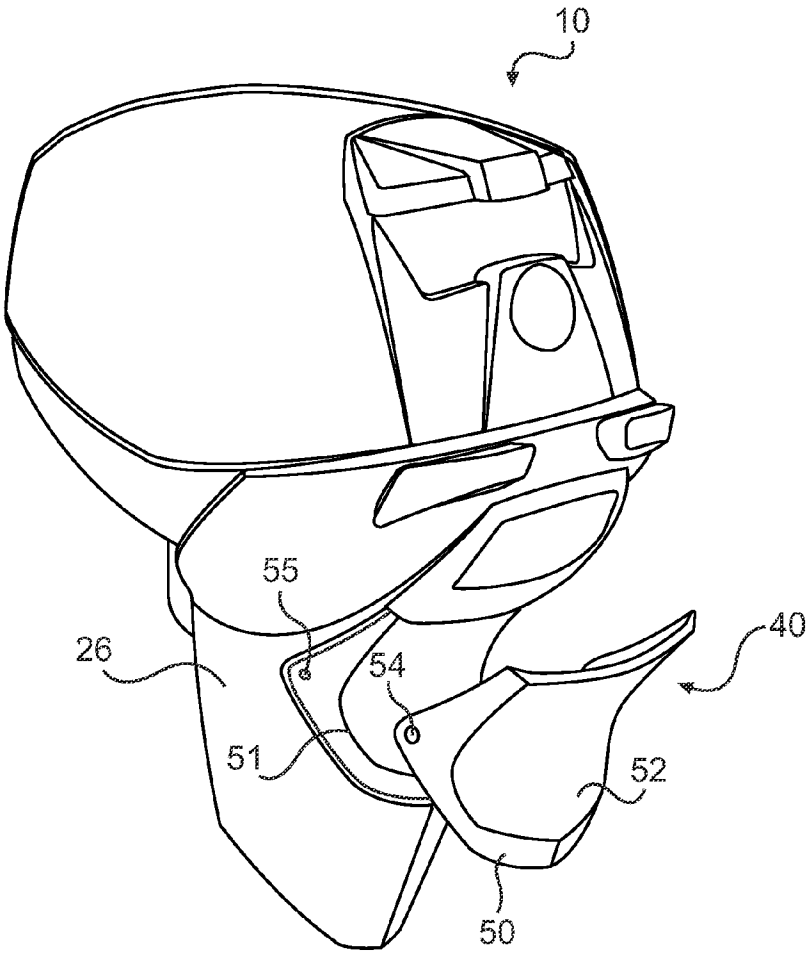
FIG. 5 is a partially exploded perspective view, taken from a rear, right side of the marine outboard engine shown in FIG. 2.
Figure 6:
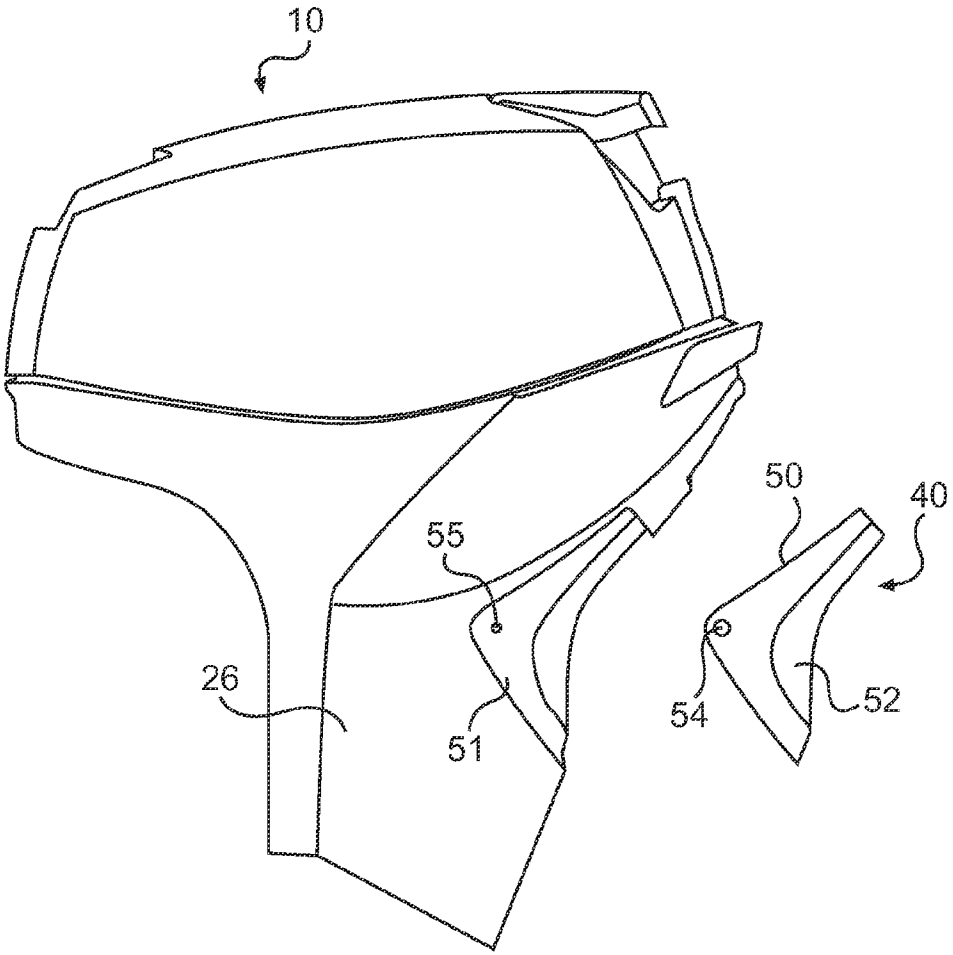
FIG. 6 is a partially exploded left side elevational view of the marine outboard engine shown in FIG. 2.

With reference to FIGS. 5 and 6, which illustrate the padded section 40 removed from the rear portion of lower motor cover 26 of the outboard engine 10, it can be seen that the padded section 40 includes a molded frame 50 onto which a cushion 52, preferably made of polyurethane or any other foamy substance, is bonded, with glue for example, or overmolded, or mechanically assembled. The overmolding process consists in molding a synthetic material directly over an existing part. The molded frame 50 is designed to fit and mate with a recessed portion 51 of the lower motor cover 26 adapted to receive the padded section 40. The molded frame 50 is provided with a pair of apertures 54, one on each side, which align with a pair of threaded apertures 55 provided on each side of the recessed portion 51. The padded section 40 is secured into the recessed portion 51 and onto the lower motor cover 26 via a pair of threaded fasteners (not shown). When the padded section 40 is secured onto the lower motor cover 26, it is visually integrated into the overall lines of the outboard engine 10, thereby generating an aesthetically pleasing outboard engine.

Figure 7:
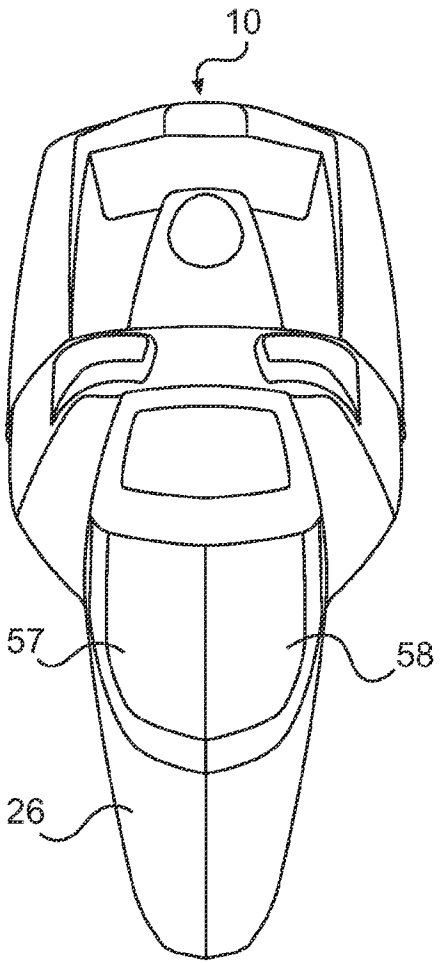
FIG. 7 is a partial left rear elevational view of a marine outboard engine in accordance with a second embodiment of the invention.

The padded section 40 can be either a one-piece cushion as illustrated in FIGS. 2 to 6 or it can divided into two pieces, a left side padded section 57 and a right side padded section 58 mounted separately onto the left and right side of the lower motor cover 26 respectively as shown in FIG. 7. The two padded sections 57 and 58 are fastened to the left and right lateral pieces of the lower motor cover 26 prior to assembling the lateral pieces of the lower motor cover 26 onto the outboard engine 10.

Figure 9:
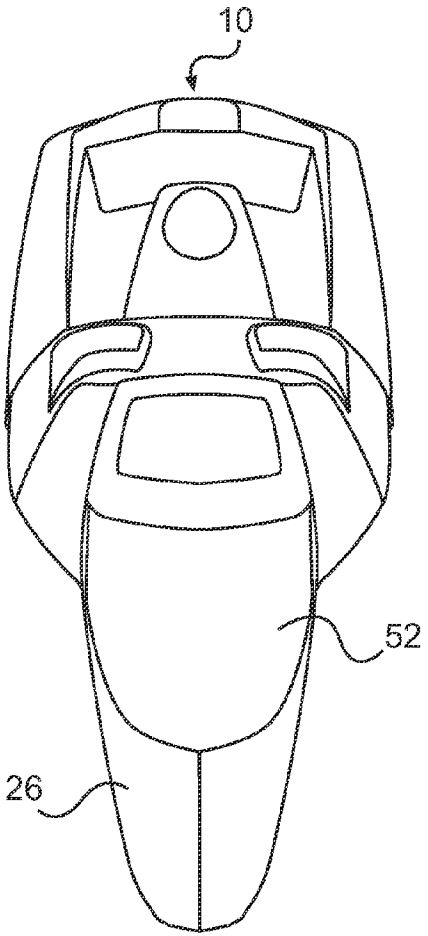
FIG. 9 is a partial rear elevational view of a marine outboard engine shown in FIG. 8.
Figure 8:
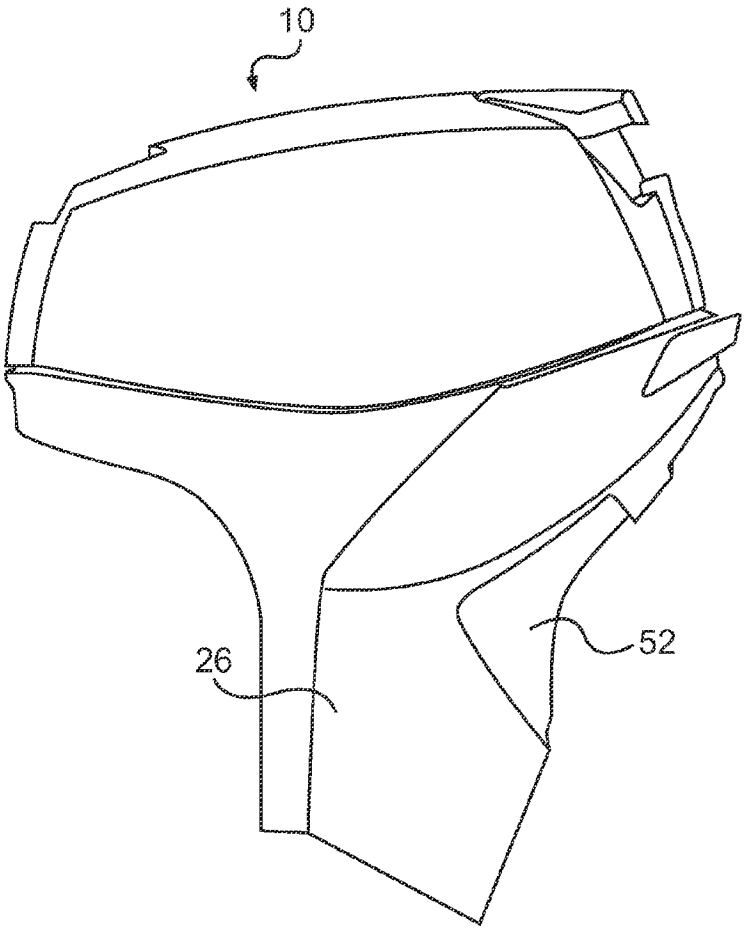
FIG. 8 is a partial side elevational view of a marine outboard engine in accordance with a third embodiment of the invention.
Figure 10:
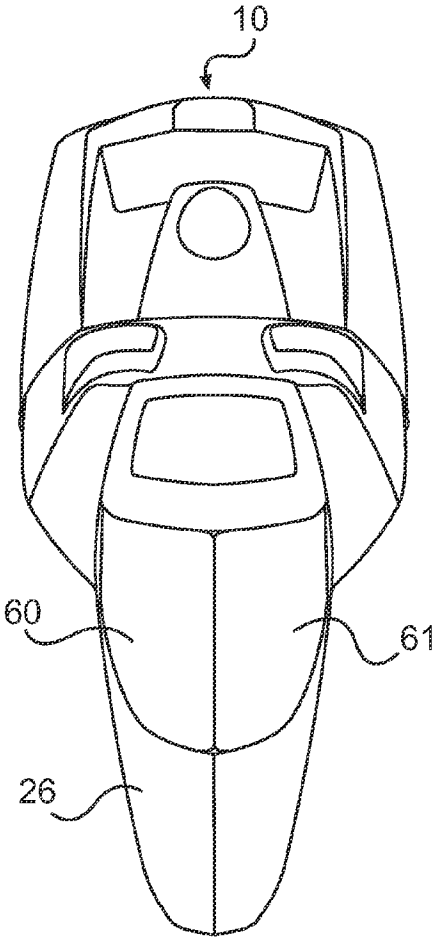
FIG. 10 is a partial rear elevational view of a marine outboard engine in accordance with a fourth embodiment of the invention.

In another embodiment of the outboard engine 10, the cushion 52 may be glued or overmolded directly onto the recessed portion 51 of the lower motor cover 26 as illustrated in FIGS. 8 and 9. In a further variant illustrated in FIG. 10, the cushion may be divided into a left cushion 60 which is affixed to the left side of the lower motor cover 26 and a right cushion 61 which is affixed to the right side of the lower motor cover 26 thereby accommodating a lower motor cover 26 formed as two lateral pieces mating along a vertical joint. The left and right cushions 60 and 61 are bonded, with glue for example, or overmolded, or mechanically assembled directly to their respective lateral piece of the lower motor cover 26 prior to assembling each lateral piece onto the outboard engine 10.

Figure 11:
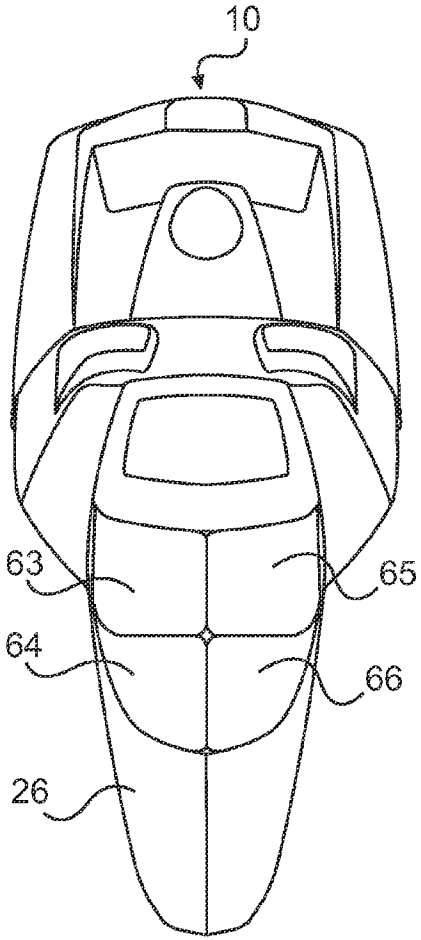
FIG. 11 is a partial rear elevational view of a marine outboard engine in accordance with a fifth embodiment of the invention.

In yet another embodiment of the outboard engine 10, the padded section may include four cushions, two cushions 63 and 64 which are affixed to the left side of the lower motor cover 26 and two cushions 65 and 66 which are affixed to the right side of the lower motor cover 26 as shown in FIG. 11. The four cushions 63, 64, 65 and 66 together define curved profile as illustrated in FIG. 3 and provide a large padded area for the shoulder of the person carrying the outboard engine 10.

Modifications and improvement to the above described embodiments of the present invention may become apparent to those skilled in the art. The foregoing description is intended to be exemplary rather than limiting. Furthermore, the dimensions of features of various components that may appear on the drawings are not meant to be limiting, and the size of the components therein can vary from the size that may be portrayed in the figures herein. The scope of the present invention is therefore intended to be limited solely by the scope of the appended claims.

What is claimed is:

1. A marine outboard engine comprising:

a cowling having at least an upper motor cover and a lower motor cover, the upper motor cover being positioned above the lower motor cover and being detachable from the lower motor cover;

an engine disposed in the cowling;

a transmission operatively connected to the engine;

a bladed rotor operatively connected to the transmission; and a padded section directly connected to a rear portion of the lower motor cover and adapted for cushioning the marine outboard engine when carried over the shoulder of a person.

2. A marine outboard engine as defined in claim 1, wherein the padded section includes at least one cushion.

3. A marine outboard engine as defined in claim 2, wherein the padded section includes a molded frame having a first side and a second side, the at least one cushion being connected to the first side of the molded frame, the second side of the molded frame being connected to the cowling of the marine outboard engine.

4. A marine outboard engine as defined in claim 3, wherein the lower motor cover includes a recessed portion in the rear portion thereof, the second side of the molded frame of the padded section being connected with the recessed portion.

5. A marine outboard engine as defined in claim 2, wherein the padded section is divided into a left side padded section and a right side padded section, the left side padded section and the right side padded section being mounted separately onto a left side and a right side of the cowling respectively.

6. A marine outboard engine as defined in claim 5, wherein each of the left and right padded sections include a molded frame, the at least one cushion being connected to a first side of the molded frame, and a second side of the molded frame being connected to the cowling of the marine outboard engine.

7. A marine outboard engine as defined in claim 2, wherein the at least one cushion of the padded section is connected directly onto the lower motor cover.

8. A marine outboard engine as defined in claim 7, wherein the at least one cushion of the padded section is bonded directly onto the lower motor cover.

9. A marine outboard engine as defined in claim 7, wherein the at least one cushion of the padded section is overmolded directly onto the lower motor cover.

10. A marine outboard engine as defined in claim 7, wherein the lower motor cover includes separate left and right sides; and wherein the padded section includes a left side cushion and a right side cushion, the left and right side cushions being connected directly onto the left side and the right side of the lower motor cover respectively.

11. A marine outboard engine as defined in claim 1, wherein the padded section includes a plurality of cushions, some connected directly onto a left side of the lower motor cover and the remainder connected directly onto a right side of the lower motor cover.

12. A marine outboard engine as defined in claim 1, wherein the padded section includes a curved profile adapted to conform at least partially to a contour of a shoulder of a person.

13. A marine outboard engine as defined in claim 12, wherein the curved profile includes an apex, the apex of the curved profile of the padded section providing a center point on which to balance the outboard engine when the outboard engine is resting on the shoulder of the person.

14. A marine outboard engine as defined in claim 13, wherein the apex of the curved profile of the padded section is located below a center of gravity of the marine outboard engine when the marine outboard engine is in an upright position.

15. A marine outboard engine as defined in claim 1, wherein the padded section is located in an upper portion of the lower motor cover.

* * * * *